US005479793A

United States Patent [19]

Savkar et al.

[11] Patent Number: 5,479,793

[45] Date of Patent: Jan. 2, 1996

[54] MINIMUM DWELL TIME REED RATCHET FOR WASHING MACHINE AUGERS

[75] Inventors: Sudhir D. Savkar, Niskayuna; Harold J. Jenkins, Amsterdam, both of N.Y.

[73] Assignee: General Electric Company, Schenectady, N.Y.

[21] Appl. No.: 283,430

[22] Filed: Aug. 1, 1994

[51] Int. Cl.[6] ..... D06F 17/08

[52] U.S. Cl. ..... 68/133; 192/46

[58] Field of Search ..... 68/133; 192/46

[56] References Cited

U.S. PATENT DOCUMENTS

| | | | |
|---|---|---|---|
| 405,561 | 6/1889 | Kemp | 192/46 |
| 615,614 | 12/1898 | Flood | 192/46 |
| 642,927 | 2/1900 | Schneider | 192/46 X |
| 885,060 | 4/1908 | Leatherman | 192/46 |
| 4,049,099 | 9/1977 | Zeigler | 192/46 |
| 4,155,228 | 5/1979 | Burgener, Jr. et al. | 68/133 |
| 4,164,130 | 8/1979 | Hammer | 68/133 |
| 4,719,769 | 1/1988 | Pielemeier et al. | 68/133 |

FOREIGN PATENT DOCUMENTS

| | | | |
|---|---|---|---|
| 647845 | 10/1962 | Italy | 192/46 |

*Primary Examiner*—Philip R. Coe
*Attorney, Agent, or Firm*—Paul R. Webb, II

[57] ABSTRACT

A ratchet mechanism is provided which is adapted to convert the continuously oscillating rotation of a clothes washing machine agitator to periodic rotation in a single direction for a clothes washing machine auger. The mechanism comprises a cap and a cam disc, each configured such that they may be fabricated by a single-draw mold and wherein the cap comprises a plurality of reeds that either deflect around or mechanically catch on a plurality of cam teeth disposed on the cam disc dependent upon the direction of cam disc rotation such that the rotation of the cam disc is transmitted to the cap in only one direction wherein the transmission of the rotation does not depend solely on friction. The cap serves a further function of sealing the top of the auger and thereby preventing the ingress of matter associated with a clothes washing machine, such as water or detergent, into the ratchet mechanism.

18 Claims, 3 Drawing Sheets

MINIMUM DWELL TIME REED RATCHET FOR WASHING MACHINE AUGERS

BACKGROUND OF THE INVENTION

1. Field of the Invention

A washing machine which is adapted to wash clothing will generally provide a vertically mounted agitator apparatus which will oscillate rotationally to churn the clothing therein. It is also often desirable to stimulate the motion of the clothing in a direction parallel to the rotational axis of the agitator to promote uniform washing of all articles within the machine. To this end, an auger may be mounted on the upper end of a machine's agitator to direct the clothing floating at the top of the agitator to the bottom of the agitator. Because a typical auger employs helical screw-type threads at its exterior to accomplish downward direction of clothing, the auger must only be rotated in a single direction to accomplish its purpose.

The instant invention therefore relates generally to a ratchet mechanism apparatus for transforming continuously oscillating rotation into periodic rotation in a single direction. More specifically, the ratchet mechanism of the instant invention is adapted to drive an auger which is mounted on the agitator of a clothes washing machine.

It has been discovered that a ratchet mechanism which will accommodate typical auger-agitator systems can be accomplished by a two piece system comprising a cap which seals the upper end of the auger and employs a plurality of reeds and a cam employing a plurality of cam teeth to interact with the reeds wherein each piece may be fabricated by a single-draw mold.

2. Description of the Related Art

Previous attempts to provide a clutch mechanism for a washing machine auger have typically employed five or six parts and transferred the motion of the agitator to the auger by means of friction. Other attempts to provide ratchet mechanisms for a washing machine auger have employed five or six parts. Beyond the parts employed for the clutch or ratchet mechanism, a cap was also required to keep the mechanism free of the various liquids and detergents associated with a washing machine. Also, some parts used in such previous attempts do not lend to a simple single-draw mold. Lastly, previous attempts often require the auger to be specially configured to accept the mechanism and work as part of it.

Problems associated with a larger number parts are well known in the art. Costs of production correlate directly with the number of parts due to fabrication of the parts, stocking of the parts and assembly of the mechanism. Costs of the mechanism further increase with the complexity of fabrication of each part.

Problems with previous mechanisms also arise from the use of friction to drive the auger. Those parts providing the frictional interface will consequently wear and eventually allow slippage of the auger with respect to the agitator. Also, intrusion of water or washing machine detergent into the mechanism, due either to cracked parts or wear of sealing units, will promote slippage of the auger with respect to the agitator.

The principle object of the instant invention is therefore to provide a ratchet mechanism which comprises as few parts as possible.

It is a further object of the instant invention to provide a ratchet mechanism comprising parts which can be fabricated by simple and inexpensive production techniques.

It is a further object of the instant invention to provide a ratchet mechanism which does not require a specially configured auger and may therefor be employed with auger-agitator systems designed for other ratchet mechanisms.

It is a further object of the instant invention to provide a ratchet mechanism which does not rely on friction to transmit motion from the agitator to the auger in a washing machine application.

It is a further object of the instant invention to provide a ratchet mechanism which incorporates a cap used to keep the mechanism free of liquids and detergents as part of the mechanism to further reduce the total number of parts.

SUMMARY OF THE INVENTION

The above and other objects of the instant invention are accomplished by providing an improved and more cost efficient ratchet mechanism which may be applied to transform the continuously oscillating rotation of a typical clothes washing machine agitator to periodic rotation in a single direction for a typical clothes washing machine auger. This is accomplished by the preferred embodiment of the instant invention which provides a cam disc, for mounting to a washing machine agitator, comprising a plurality of cam teeth formed in its exterior and a cap, for mounting to a washing machine auger, mounted over said cam disc wherein said cap comprises a plurality of reeds which extend downward and mesh with said cam teeth wherein said reeds will deflect outward around said cam teeth when said cam disc rotates in a first direction, thereby allowing said cam disc to rotate with respect to said cap, yet lock against said cam teeth when said cam disc rotates in a direction opposite to said first direction, thereby causing said cap to rotate with said disc. This is accomplished by rounding a first side of each cam tooth as well as an adjacent side of each respective reed to promote slippage of each with respect to the other and outward deflection of said reeds when said disc rotates in said first direction and providing a flat on a second side of each said cam tooth as well as an adjacent side of each respective reed to lock each cam tooth with respect to each respective reed thereby preventing any rotation of each with respect to the other when said cam disc rotates in said opposite direction. Therefore, when the cam teeth lock to the ratchets, the rotation of the cam disc is imparted to the cap and consequently the auger. This affords auger rotation in a single direction where the agitator driving the auger rotates in an oscillating manner.

DETAILED DESCRIPTION OF THE PREFERRED EMBODIMENT

Figure 1:
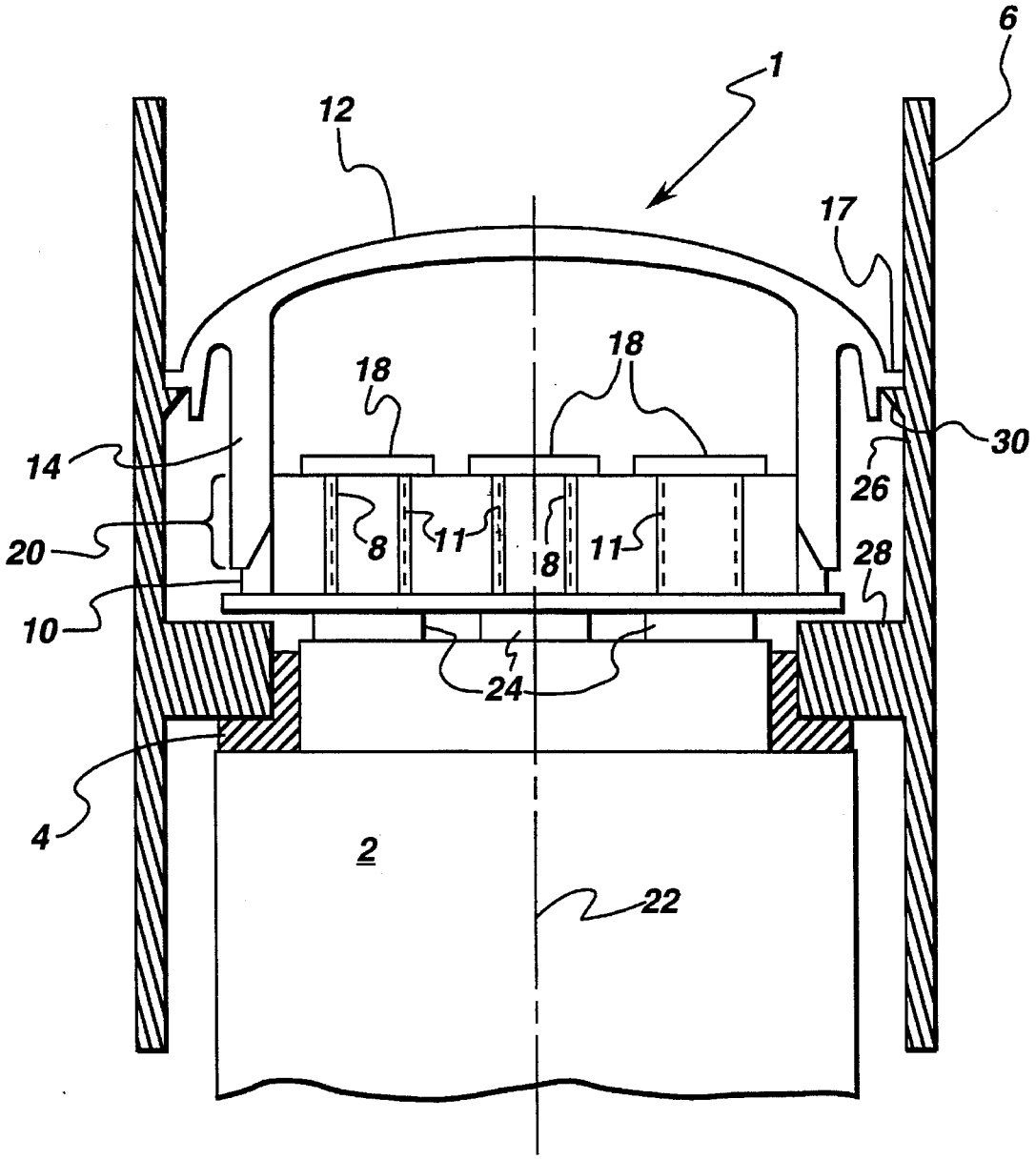
FIG. 1 is a substantially schematic view of a cross-section, taken along the axis of rotation, of the ratchet mechanism of the preferred embodiment of the instant invention in a typical agitator-auger application.
Figure 2:
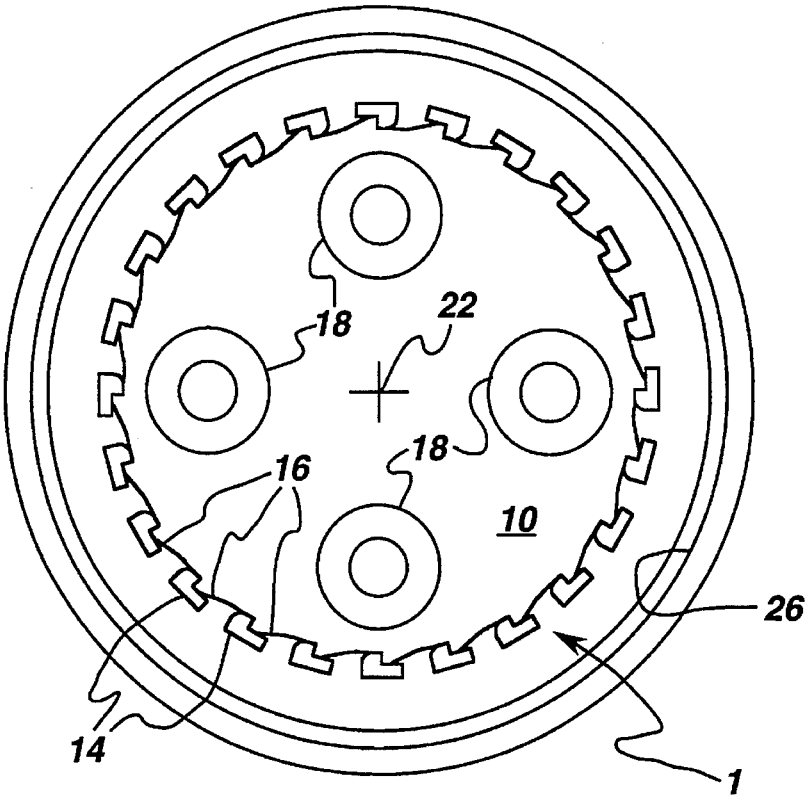
FIG. 2 is a substantially schematic view of a cross-section taken perpendicular to the axis of rotation of the ratchet mechanism of the preferred embodiment of the instant invention in a typical agitator-auger application.

The present invention is accomplished by a minimum dwell time reed ratchet mechanism 1 depicted in a preferred embodiment assembly in FIGS. 1–2 showing application to a typical washing machine environment. A typical washing machine agitator 2 supports a bearing 4 on which rests a typical washing machine auger 6 (helical screw-type threads not shown for simplicity). A plurality of fixing posts 8 secure a cam disc 10 to agitator 2 and a cap 12 is affixed to auger 6.

Assembly of the embodiment depicted in FIGS. 1–2 is accomplished by first placing bearing 4 over the top of agitator 2 until it rests as shown, then slipping auger 6 over agitator 2 and bearing 4 until auger 6 seats on beating 4. Next, cam disc 10 is guided into place by sliding fixing post holes 11 over fixing posts 8 which are then vibration welded and mashed over cam disc 10 to hold cam disc 10 secure to agitator 2. Cap 12 is then slid into auger 6 and over cam disc 10 where cap 12 and auger 6 are spin welded to one another.

FIG. 2 depicts a plurality of reeds 14 which extend downward from cap 12 to mesh with a plurality of cam teeth 16 disposed about the circumference of cam disc 10. In the preferred embodiment, cap 12 is integrally formed in a single piece and has a chamfer located at the lowermost end thereof for assisting the placement of cap 12 over cam disc 10 during assembly of the ratchet mechanism. Although FIG. 2 depicts reeds 14 and cam teeth 16 meshing at the outer diameter of the cam disc 10, it is contemplated that the cam teeth 16 could be disposed at an inner diameter of cam disc 10 where said reeds 14 would mesh therewith. In such an embodiment, the fixing posts 8 would necessarily be shorter having an upper post end 18 closer to the agitator 2 than depicted in FIG. 1 to allow inward deflection of the reeds; the deflection described in greater detail herein below.

In addition to providing reeds 14, cap 12 seals the upper end of auger 6 from ingress of liquids and detergents once a lip 17 disposed at the outer diameter of cap 12 is spin welded to auger 6. Most agitator-auger systems require a cap attached above the mechanism after installation of the clutch or ratchet mechanism 1. In combining the functions of an auger cap and a half of the instant ratchet mechanism 1, cap 12 has thereby reduced the total number of parts of the agitator-auger system by another part.

To further simplify the instant system, each of cap 12 and cam disc 10 are designed such that they can be single-draw molded which also further reduces cost. Cap 12 is to be molded of polypropylene to allow spin welding of cap 12 to typical auger 6 which is also typically made of polypropylene. For reasons discussed below, cam disc 10 is preferably molded from a polyoxymethylene, acetal resin in a preferred embodiment, or like material as will be obvious to one of ordinary skill in the art.

Bearing 4 dictates the proper over lap 20 of cap 12 and cam disc 10 and keeps the rotation of auger 6 stable. Bearing 4 should be constructed of a material which will keep friction between said bearing 4 and auger 6 to a minimum. Binding of auger 6 is thereby prevented keeping high stresses due to impulse loads between cam disc 10 and cap 12 to a minimum level. Although bearing 4 could be constructed of the same material as auger 6 a material such as nylon or a polyoxymethylene, preferably an acetal resin, should be chosen for bearing 4 to keep friction between said bearing 4 and auger 6 to a minimum and prevent binding. Other such materials should be readily apparent to one skilled in the art.

FIG. 2 shows the plurality of fixing posts 8 in the preferred embodiment comprising four posts. Although two or three posts would transmit rotation from agitator 2 to cam disc 10, the use of four fixing posts best accomplishes keeping cam disc 10 perpendicular to axis of rotation 22 of the agitator-auger assembly. This is desirable to ensure a proper interface between cap 12 and cam disc 10; said interface discussed in detail herein below. It is, however, contemplated that a two or three post plurality of fixing posts 8 could accomplish such objectives where each post upper end 18 and post lower end 24 is made large enough to provide ample support for cam disc 10. The required sizes of upper post end 18 and lower post end 24 are easily determined by routine experimentation for a given number of fixing posts 8. In a preferred embodiment, the plurality of fixing posts 8 are integral with agitator 2 and post upper ends 18 are vibration melted and mashed down to hold cam disc 10 to agitator 2. It is also contemplated that lower post ends 24 could be eliminated and their function replaced by extending agitator 2 upward to hold cam disc 10 stable.

Auger 6, in a preferred embodiment, is a typical auger as well known in the art of clothes washing machines. Other types of augers are also contemplated however. The helical screw-type threads (not depicted) of auger 6 may be spiral downward either clockwise or counter-clockwise so long as the ratchet mechanism 1 is coordinated to rotate the auger in the same direction which the threads spiral downward. The inner diameter 26 of auger 6 need no special teeth or other surface configuration to accommodate the ratchet mechanism 1 as did some prior auger assemblies. The inner diameter 26 of auger 6 only needs auger support 28 and lip 30 to which cap 12 is welded.

One of the objectives of the instant ratchet mechanism 1 is accomplished in that it may accommodate special configurations (none shown) of auger 6 required by other ratchet mechanisms. This accommodation is afforded the instant mechanism 1 because the operation of the mechanism 1 is accomplished disparate from said inner diameter 26 of said auger 6. Auger configurations for other ratchet mechanisms will not, therefore, interfere with the operation of the instant ratchet mechanism 1. Consequently, the ratchet mechanism 1 of the instant invention may be used to replace ratchet mechanisms of different configurations without replacing the auger used with that configuration.

Although cam disc 10 could be integrally molded to auger 6, it is anticipated that the instant mechanism 1 may be used as a replacement mechanism for older mechanisms which either wore out due to friction or have developed problems after extended use in the field. Replacing the ratchet mechanism would therefore be preferable to replacing the mechanism and auger as a unit. Integrally molding cam disc 10 to auger 6 would also remove the single-draw mold capability of cam disc 10 and complicate molding cam disc 10 of a nylon or a polyoxymethylene. Consequently, cam disc 10 has fixing post holes 11 for accepting a the plurality of fixing posts 8 extending from agitator 2.

Figure 3A:
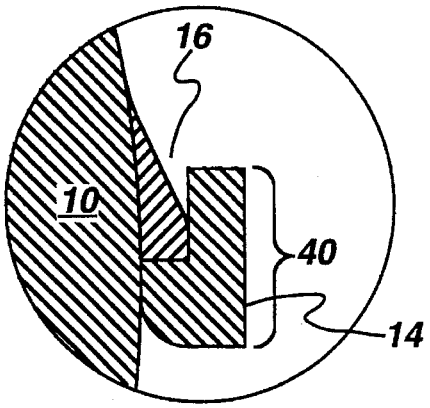
FIG. 3*a* is a substantially schematic view of a single reed locked against a single cam tooth in a mesh position.
Figure 3B:
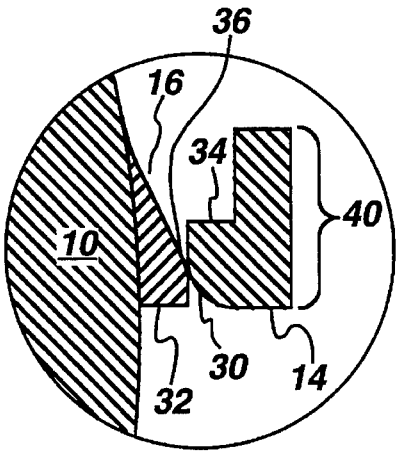
FIG. 3*b* is a substantially schematic view of a single reed deflected by a single cam tooth.

As agitator 2 oscillatingly rotates cam disc 10, said disc will rotate clock-wise and counter clock-wise as seen from the view of FIG. 2. FIGS. **3*a*–3*b* depict an isolated view of a single cam tooth 16 with a single reed 14, each in their preferred embodiment configuration. FIG. 3*b* shows each of the cam tooth 16 and the reed 14** having a flat trailing edge, 32 and 34 respectively, complementary to that of the other. Although the fiats depicted here are along a radius of the cam disc 10, it is contemplated that various angles with respect to the radius of the cam disc 10 would achieve the objective of the instant invention and would not depart from the inventive idea thereof.

Each of the cam teeth 16 and the reeds 14 also have a leading edge, 36 and 38 respectively, comprising a curvature to direct each reed 14 around each cam tooth 16. In the preferred embodiment, the leading edge 36 of each cam tooth 16 is to be of a cycloidal shape which would minimize the acceleration of reed 14 when deflecting as shown in FIG. 3*b*. Various curvatures of each leading edge 36, 38 would accomplish the objective of the instant invention and would not depart from the inventive idea thereof.

As cam disc 10 rotates clock-wise, the trailing edge 32 of each cam tooth 16 will catch the trailing edge 34 of an adjacent reed 14. The stiffness of the reed 14 will tend each reed 14 toward a mesh position as depicted in FIG. 3*a* and keep the trailing edge 34 of reed 14 locked to the trailing edge 32 of cam tooth 16 so long as the cam disc 10 rotates clock-wise. Because the reeds 14 are locked to rotating cam disc 10, cap 12, and consequently auger 6 welded thereto, will rotate clock-wise in concert with cam disc 10.

To ensure that the reeds 14 facilitate a proper connection between the cam disc 10 and the cap 12, the length of contact 20 between the cam teeth 16 and the reeds 14 is designed to keep pressure low enough that the stiffness of the reed 14 may keep the mesh locked. A longer distance of mesh between cam teeth 16 and reeds 14 also provides a greater surface area of contact such that when wear of the cam teeth 16 and reeds 14 occurs, and the fiats of the trailing edges 32, 34 of each becomes smaller, the pressure to maintain a locked mesh can still be accomplished due to the length of contact 20.

When cam disc 10 stops rotating clock-wise and begins to rotate counter clock-wise, the leading edge 36 of each cam tooth 16 will encounter the leading edge 38 of an adjacent reed 14, as depicted in FIG. 3*b*, and deflect around said cam tooth 16. During a period of counter clock-wise rotation, each reed 14 will deflect around a plurality of cam teeth 16 in the manner described above. The exact number of cam teeth 16 passed by each reed 14 will depend upon the number of cam teeth 16 on cam disc 10 and the number of degrees of rotation of agitator 2 in a single period of rotation. As a result of each reed 14 deflecting around each cam tooth 16 which it encounters during counter clock-wise rotation of agitator 2, cap 12 and auger 6 remain stationary during such rotation. Consequently, auger 6 will only be rotated in the clock-wise direction and accomplish its objective of directing the articles around it in a downward direction.

As depicted in FIGS. 3*a*–3*b*, each reed 14 is further designed, in a preferred embodiment, to comprise a cross-section of rectangular form integral with a lobe possessing a curvature for leading edge 38 and a fiat for trailing edge 34. The length 40 of the rectangular cross-section is disposed tangent to the circumference of the cam disc 10 thereby directing a majority of the reed deflection in the radial direction as a result of the component bending moments of reed 14. This configuration will minimize the total deflection of each reed 14. Minimizing the acceleration and deflection of reeds 14 will allow their deflection to follow the surface of cam teeth 16 without loosing contact therewith. A cam disc material such as a polyoxymethylene, preferably an acetal resin, is chosen to keep friction minimal and promote constant contact. As a consequence, each reed 14 will return to cam disc 10, upon the passing of each cam tooth 16, with a minimum level of energy. In that any said energy would be dissipated in part as sound, a quiet ratchet mechanism is accomplished.

Figure 4:
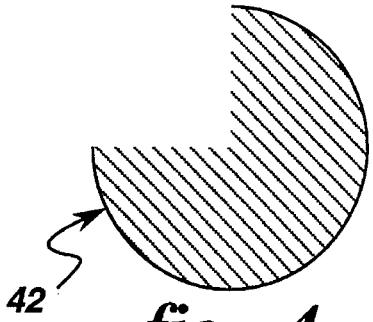
FIG. 4 is a substantially schematic view of an alternate cross-section of reed depicted in FIGS. 3*a*–3*b*.

From the foregoing description it is contemplated that one of ordinary skill in the art will recognize that reeds of other cross-section will accomplish the objective of a quiet ratchet mechanism. FIG. 4 depicts an alternate embodiment reed 42 which will substantially accomplish the objects of the instant invention.

Each reed 14 is further designed to have a resonant frequency which is higher than the rate at which the cam teeth 16 will pass by it when the cam disc 10 rotates counter clock-wise. In this manner the reeds 14 will not resonate. Resonating of the reeds 14 could cause them to miss catching the cam teeth 16 upon reversal of direction of rotation and create sound thereby deteriorating the quiet characteristic of the instant mechanism.

Figure 5:
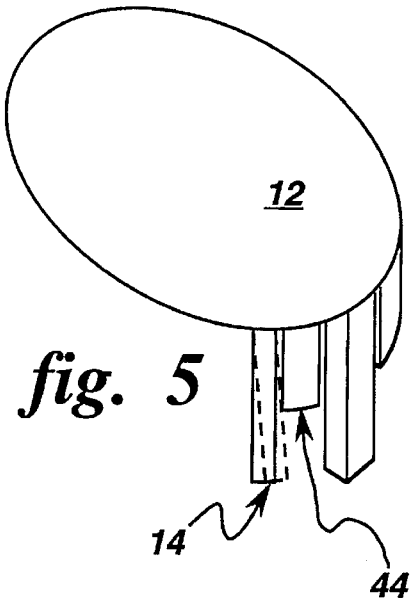
FIG. 5 is a substantially schematic view of an alternate cap employing backup support for the reeds.

It is contemplated that the properties of each reed 14, may be altered by variation of the shape and dimensions of each reed 14 as well as the material of the cap 12 through routine experimentation. If, for example, small reeds 14 are designed to increase the number thereof, they will have low resistance to deflection in a direction tangent to the circumference of the cam disc 10. A backup support 44 depicted in FIG. 5 can be disposed between each set of adjacent reeds 14. Each backup support 44 comprises a stub extending from the cap substantially parallel to reeds 14 to support each reed 14 from tangential deflection. In a preferred embodiment cap 12 comprises twenty four (24) reeds 14 and forty eight (48) cam teeth 16. This allows cap 12 to quickly catch cam disc 10 upon reversal from clock-wise rotation to counter clock-wise rotation while leaving ample room between adjacent reeds 14 to insert backup supports 44 where desired.

It is also recognized that the length of each reed 14 and the distance from the cap at which the cam disc 10 contacts each reed 14 will contribute to the resistance to deflection which each reed 14 will exert. Each of these factors may be varied to accomplish minimal total deflection and acceleration of each reed 14 to accomplish the objectives discussed above.

Figure 6:
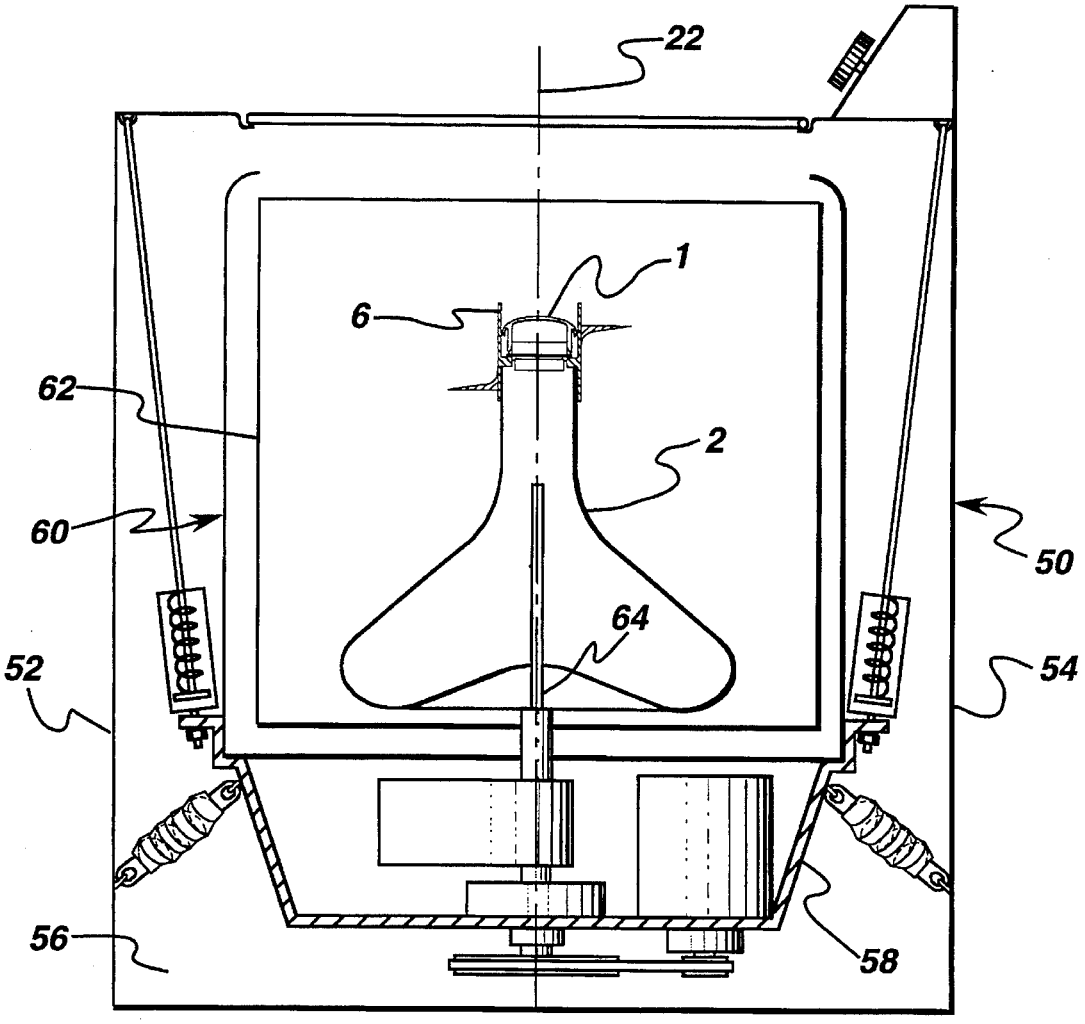
FIG. 6 is a substantially schematic view of a typical washing machine employing the ratchet mechanism of the instant invention.

FIG. 6 depicts a clothes washing machine which would employ the ratchet mechanism 1 of the instant invention. The machine comprises housing 50 having a front panel 52, rear panel 54 and panel 56, a mounting platform 58 within said housing, a tub 60 having a vertical axis 22 coincident with the axis of rotation of an agitator 2 wherein tub 60 is mounted on mounting platform 58 within the housing 50 and at a position spaced from each of said housing panels. The machine further comprises a basket 62 in tub 60 being of sufficient size for holding articles to be washed, means 64 for imparting oscillating motion to an agitator 2 and a minimum dwell time reed ratchet 1 of the instant invention for driving an auger 6. The axis of rotation 22 of the ratchet mechanism 1 and auger 12 being coincident with the vertical axis of tub 60 and agitator 2.

It is to be recognized that the foregoing detailed description of the preferred embodiment of the instant invention is given merely by way of illustration, and that numerous modifications and variations may become apparent to those skilled in the art without departing from the spirit and scope of the invention. Therefore, the scope of the present invention is to be determined by reference to the appended claims.

We claim:

1. A ratchet mechanism for rotating about an axis of rotation, said mechanism comprising;

a cam disc provided with a plurality of cam teeth extending substantially radially from its outer diameter;

a cap provided with a plurality of reeds extending integrally therefrom and meshing with the cam teeth;

the reeds being flexible for deflecting around the cam teeth when the cam disc is rotated in a first direction about the axis of rotation, thereby allowing the cam disc to rotate relative to the cap; and each reed having a trailing edge for engaging a trailing edge of an adjacent one of the cam teeth when the cam disc is rotated in a second direction which is opposite to said first direction.

2. The ratchet mechanism of claim 1, wherein said cap is disposed over said cam disc and said reeds extend downward in a direction parallel to the axis of rotation of the ratchet mechanism when said reeds are meshed with said cam teeth but move out of parallel when deflecting.

3. The ratchet mechanism of claim 2, wherein said cap further comprises a lip at an outer diameter thereof to be connected to a clothes washing machine auger and said cam disc further comprises fixing holes to connect said cam disc to a clothes washing machine agitator.

4. The ratchet mechanism of claim 3, wherein each of the cap and the cam disc are adapted to be fabricated by a single-draw mold.

5. A ratchet mechanism for converting a continuously oscillating rotation of a washing machine agitator into periodic rotation in a single direction for a washing machine auger, said ratchet mechanism comprising;

a cam disc adapted to be attached to the washing machine agitator, said cam disc comprising a plurality of cam teeth;

a cap adapted to be attached to the washing machine auger, the cap comprising a plurality of reeds adapted to mesh with the plurality of cam teeth;

each of the plurality of reeds being adapted to deflect when the cam disc rotates in a first direction whereby the plurality of reeds become unmeshed from the plurality of cam teeth to allow the cam disc to rotate relative to the cap; and each of the plurality of reeds further being adapted to remain meshed with the plurality of cam teeth when the cam disc rotates in a second direction which is opposite to the first direction.

6. The ratchet mechanism of claim 5, wherein the cap is adapted to be attached to the auger in a manner which will seal the upper end of the auger against intrusion of matter.

7. The ratchet mechanism of claim 5, wherein the plurality of cam teeth comprises forty eight cam teeth and the plurality of reeds comprises twenty four reeds.

8. The ratchet mechanism of claim 5, wherein each of the cap and the cam disc are adapted to be fabricated by a single-draw mold.

9. The ratchet mechanism of claim 5, wherein each of the plurality of reeds extend downward from the cap in a direction parallel to the axis of rotation about which the ratchet mechanism is adapted to rotate when the reeds are meshed with the cam teeth but move out of parallel when deflected.

10. The ratchet mechanism of claim 9, wherein the plurality of reeds are formed integrally to said cap.

11. The ratchet mechanism of claim 9, further comprising a plurality of backup supports extending downward from the cap such that one of the plurality of backup supports is disposed between each set of adjacent reeds for supporting the reeds against bending.

12. The ratchet mechanism of claim 9, wherein each of the plurality of reeds comprises;

a leading edge having a curvature which is adapted to contact adjacent cam teeth when the cam disc rotates in the first direction;

a trailing edge comprising a fiat which is adapted to contact an adjacent one of the cam teeth when the cam disc rotates in the second direction;

wherein each of the plurality of cam teeth comprise;

a leading edge having a cycloidal form which is adapted to contact an adjacent reed leading edge when the cam disc rotates in the first direction; and a trailing edge comprising a fiat which is adapted to contact an adjacent reed trailing edge when the cam disc rotates in the second direction.

13. The ratchet mechanism of claim 12, wherein the cycloidal form of each said cam tooth leading edge is adapted to minimize the acceleration of each reed which it contacts when the cam disc rotates in the first direction.

14. The ratchet mechanism of claim 13, wherein each of the plurality of reeds has a thickness of the reed measured along a tangent to the cam disc which is substantially greater than a thickness of the reed measured along a radius of the cam disc.

15. The ratchet mechanism of claim 12, wherein each of the plurality of reeds comprises a stiffness adapted to yield a reed resonant frequency higher than the cam tooth passing frequency when the cam disc rotates in the first direction to prevent resonating of the reeds.

16. The ratchet mechanism of claim 12, wherein said mechanism is adapted to be installed disparate from an inner diameter of said clothes washing machine auger such that protrusions extending inward from the auger inner diameter would not interfere with rotation of the cam disc in either the first or second direction.

17. A machine for washing articles, comprising;

a housing having a front panel, rear panel and side panel, a mounting platform within said housing, a tub having a vertical axis and being mounted on said platform within said housing at a position spaced from each of said housing panels;

a basket in said tub having a size sufficient for holding articles to be washed, an agitator within said basket wherein the agitator rotates in an oscillating motion which facilitates washing of said articles, an auger mounted at the top of said agitator wherein the auger rotates in a single direction to facilitate moving articles from the top of the basket to the bottom of the basket to accomplish an evenly washed load, a ratchet mechanism mounted between the agitator and the auger to transform the continuously oscillating rotation of the agitator into a periodic rotation in a single direction for the auger, means for imparting oscillating motion to said agitator during a wash cycle, wherein said ratchet mechanism comprises a cam disc attached to the agitator, the cam disc comprising a plurality of cam teeth;

a cap attached to the auger in a manner sealing the top of the auger against intrusion of matter, the cap comprising a plurality of reeds meshed with the plurality of cam teeth wherein the plurality of cam teeth is disparate from an inner wall of the auger, each of the plurality of reeds being adapted to deflect when the cam disc rotates in a first direction whereby the plurality of reeds becomes unmeshed from the plurality of cam teeth to allow the cam disc to rotate with respect to the cap, each of the plurality of reeds further being adapted to remain meshed with the plurality of cam teeth when the cam disc rotates in a second direction which is opposite to the first direction, and each of the plurality of reeds comprising a chamfer on lower end thereof to promote placement of the cap over the cam disc during assembly of the ratchet mechanism.

18. The machine of claim 17, wherein each of the cap and the cam disc are adapted to be fabricated by a single-draw mold.

* * * * *